US005738211A

United States Patent [19]

Ichino et al.

[11] Patent Number: 5,738,211

[45] Date of Patent: Apr. 14, 1998

[54] PACKAGING BAG

[75] Inventors: Shuichi Ichino; Toshihide Nagasaka; Fumio Mitsuhashi, all of Kanagawa, Japan

[73] Assignee: Fuji Photo Film Co., Ltd., Kanagawa, Japan

[21] Appl. No.: 736,814

[22] Filed: Oct. 25, 1996

[30] Foreign Application Priority Data

Oct. 25, 1995 [JP] Japan ..... 7-277581

[51] Int. Cl.[6] ..... B65D 85/38

[52] U.S. Cl. ..... 206/316.2; 383/9; 383/200

[58] Field of Search ..... 206/316.2; 383/9, 383/10, 200–209

[56] References Cited

U.S. PATENT DOCUMENTS

| | | | |
|---|---|---|---|
| 3,458,111 | 7/1969 | Leasure et al. | 383/201 |
| 5,337,099 | 8/1994 | Tasaka et al. . | |
| 5,350,062 | 9/1994 | Takiguchi et al. | 206/316.2 |
| 5,380,094 | 1/1995 | Schmidt et al. | 383/209 |
| 5,613,779 | 3/1997 | Niwa | 383/209 |

FOREIGN PATENT DOCUMENTS

| | | | |
|---|---|---|---|
| 5-32268 | 2/1993 | Japan | 206/316.2 |
| 5-72674 | 3/1993 | Japan . | |
| 3010367 | 2/1995 | Japan . | |
| 7-175173 | 7/1995 | Japan . | |

*Primary Examiner*—Jimmy G. Foster
*Attorney, Agent, or Firm*—Young & Thompson

[57] ABSTRACT

A packaging bag for wrapping a product with an outwardly extended projection has a side sealing portion and opposite end margin sealing portions. The side margin sealing portion is formed by heat-sealing lengthwise side margins of wrapping sheet into a shape of a rectangular tube. The end margin sealing portions are formed by heat-sealing opposite end margins of the rectangular tube. A notch is provided at an edge of the first end margin sealing portion near the side margin sealing portion to make an opening in the package by tearing at least the side margin sealing portion. A tray is provided for removing the product from the packaging bag and for protecting the outwardly extended projection of the product.

9 Claims, 4 Drawing Sheets

PACKAGING BAG

BACKGROUND OF THE INVENTION

1. Field of the Invention

The present invention relates to a packaging bag. More particularly, the present invention relates to a packaging bag for wrapping a product, such as a lens-fitted photo film unit, in a hermetic manner by pillow type packaging.

2. Description Related to the Prior Art

Lens-fitted photo film units (hereinafter referred to simply as film units) have been sold at reasonable prices and used widely. Such a film unit has a simple photo-taking function and a pre-loaded photo film, making it possible to take photographs soon after its purchase without any advance preparation. After photographing, it is only necessary to bring the film unit in its entirety to a photofinishing agent.

Since the film unit is pre-loaded with a photo film, it is necessary to protect the photo film from moisture until a user actually uses it. Therefore, the film unit is packaged in a moisture-proof packaging bag, which can be easily torn off by the user.

For pillow type packaging, a continuous web of packaging material is utilized. The film units are placed on the continuous web while being conveyed, at regular intervals. Lengthwise side margins of the continuous web are gradually sealed in the course of conveying the web, so as to encircle the film unit in an envelope. The envelope is heat-sealed at a position between two of the encircled film units. After that, the envelope is cut in the heat-sealed portion into individual packaging bags wrapping the film unit with the sheet material. The packaging bag is a shape of almost a rectangular box which has a side margin sealing portion and end margin sealing portions. The side margin sealing portion is extended in a lengthwise direction, and the end margin sealing portion are extended in a widthwise direction.

A packaging bag is disclosed in Japanese Patent Laid-open Application No. 5-72674 in which a layered sheet including a uniaxially stretched polyethylene layer is utilized as a sheet material and lengthwise side margins of the layered sheet are sealed to be positioned in the center of a rear side of a film unit. This packaging bag can be torn in a single direction from a notch formed at an edge of one of end margin sealing portions.

The packaging bag is prevented from being torn off accidentally in the course of pulling the packaging bag in the lengthwise direction. However, such a sheet material having the uniaxially stretched layer is comparatively expensive. Accordingly this is not suitable for a packaging bag for the reasonable film unit.

On the other hand, Japanese Utility Model Registration No. 3,010,367 discloses a packaging bag having a side margin sealing portion and end margin sealing portions. The side margin sealing portion is formed by sealing lengthwise side margins of the sheet to be a form of an envelope. The end margin sealing portions are formed by sealing opposite free ends of the envelope. Since a notch is provided at a position close to the side margin sealing portion in one of the end margin sealing portions, the packaging bag is torn along the side sealing portion. Further, Japanese Laid-open Application No. 7-175173 discloses a packaging bag, of which a side margin sealing portion is provided with a pull tab. The side margin sealing portion is formed in the longitudinal direction of the packaging bag. The pull tab is picked and pulled so that the packaging bag is opened as the side margin sealing portion is torn off.

As these conventional packaging bags contour a shape of the product, such as a film unit, for wrapping it, the packaging bag is provided with front and rear sheet sides, and upper and lower sheet sides which are smaller in size than the front and rear sheet sides. The front and rear sheet sides respectively cover front and rear outsides of the product, and the upper and lower sheet sides respectively cover top and bottom outsides of the product.

The conventional packaging bag is provided with a side margin sealing portion to be positioned in the rear sheet side, so that, when the packaging bag is torn, an opening like a slot is formed in the rear sheet side. To remove the product, the user has to further widen the slot-like opening because the length of the slot-like opening is sufficient but the width thereof is not sufficient to remove the product. It is troublesome to remove the product from the conventional packaging bag.

Moreover, the side margin sealing portion is formed in the center of the rear sheet side. Accordingly the side sealing portion causes the rear sheet side of the packaging bag to have limited space for a printing design.

In the case that the product is a film unit, the appearance of the packaging bag would not be neat because the film unit is packaged in a tight-wrapping manner, and the packaging bag wrinkles due to a taking lens which protrudes from the front side of the film unit.

SUMMARY OF THE INVENTION

In view of the foregoing problems, an object of the present invention is to provide a packaging bag for wrapping a product from which it is convenient to remove the product.

Another object of the present invention is to provide a neat bag for wrapping a film unit.

In order to achieve the above and other objects and advantages of this invention, a packaging bag of the present invention has a side margin sealing portion formed by sealing lengthwise side margins of a sheet material to be a rectangular tube, and first and second end margin sealing portions formed by sealing opposite end margins of the rectangular tube, and a notch formed in the first end margin sealing portion in a position near the side margin sealing portion.

The rectangular tube has first to fourth sheet sides for wrapping four outsides of a product. The first and second sheet sides opposite to each other have a size larger than the third and fourth sheet sides. The side margin sealing portion is positioned in the third sheet side, or in the second sheet side but near the third sheet side.

The packaging bag is torn from the notch so that the side margin sealing portion is torn from the packaging bag and an opening is formed in the third sheet side, through which the product is removed from the packaging bag through the opening.

In the preferred embodiment, the packaging bag wraps a film unit. The film unit is wrapped in the packaging bag while a protector tray is laid on the first outside of the film unit. The protector tray serves to keep the first sheet side flat and is drawn through the opening of the packaging bag when the film unit is removed.

In the present invention, the opening is formed in the third sheet side of a smaller size, and has an approximately same size as the third sheet side. Accordingly, it is possible to take the product out of the packaging bag easily. The tray is placed on the first outside which has a projection, to keep the first sheet side flat and prevent it from wrinkling. Therefore, the neat appearance of the packaging bag can be maintained.

BRIEF DESCRIPTION OF THE DRAWINGS

The above objects and advantages of the present invention will become more apparent from the following detailed description when read in connection with accompanying drawings, in which.

DETAILED DESCRIPTION OF THE PREFERRED EMBODIMENTS OF THE PRESENT INVENTION

Figure 1:
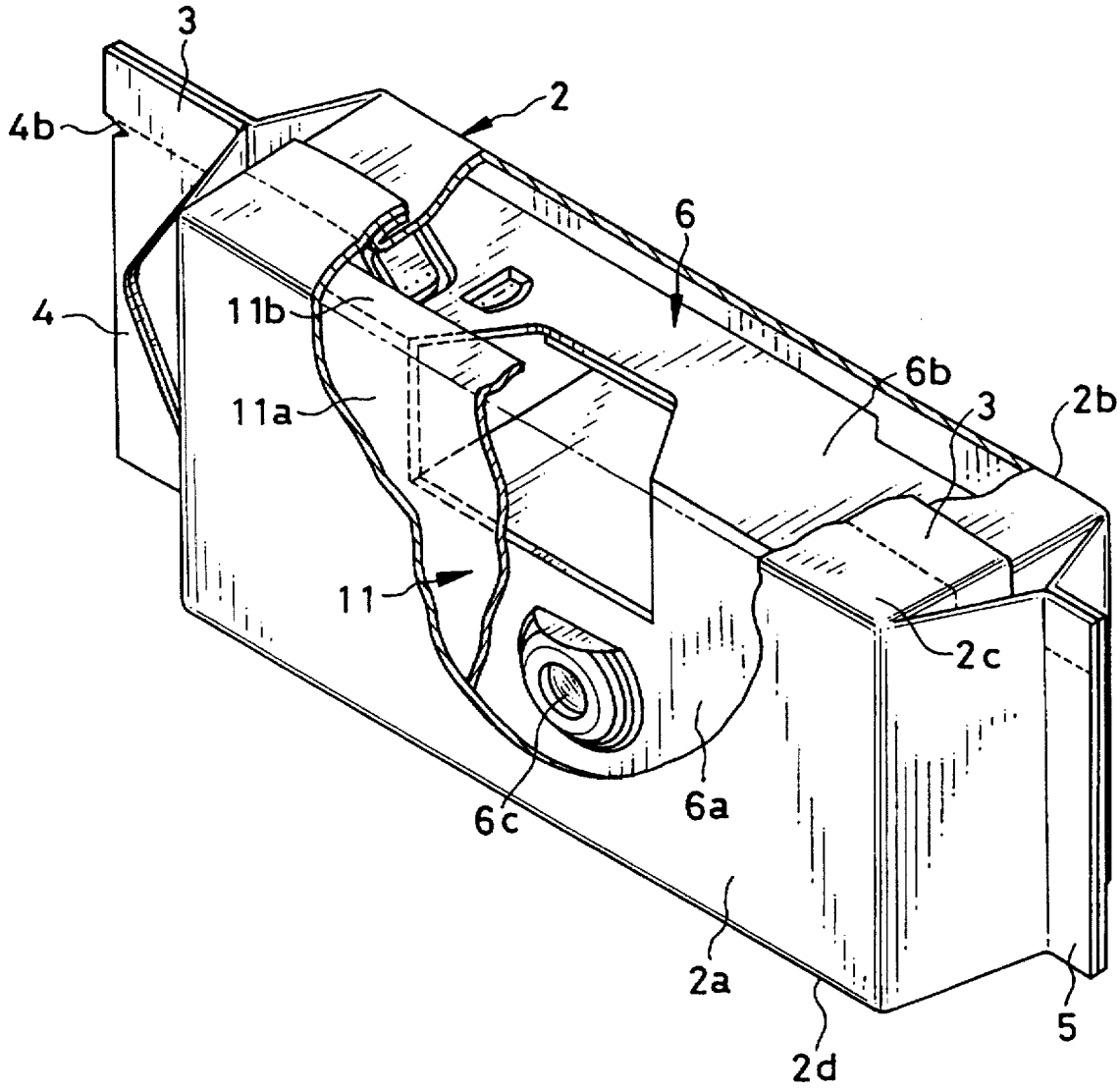
FIG. 1 is a partially broken perspective view illustrating a packaging bag for a film unit embodied in accordance with the present invention.

FIG. 1 illustrates a packaging bag 2 according to the present invention which has been partially cut away. The packaging bag 2 is formed from a sheet of a packaging material having moisture-proof and light-shielding properties, for example, a laminated polyethyleneterephthalate (PET) sheet of a two layer construction, with decorative prints. Whole inner surfaces of the PET sheet are coated with hot melt adhesive. The inner surfaces of lengthwise side margins of the PET sheet are heat-sealed to form a side margin sealing portion 3 of about 10 mm in width, so that the PET sheet is formed into a rectangular tube. The rectangular tube has front and rear sheet sides 2*a* and 2*b* and upper and lower sheet sides 2*c* and 2*d* interposing between the front and rear sheet sides 2*a* and 2*b*. The front and rear sheet sides 2*a* and 2*b* are larger in size than the upper and lower sheet sides 2*c* and 2*d*.

After a film unit 6 is wrapped in the rectangular tube, the inner surfaces of opposite end margins of the rectangular tube are heat-sealed to form first and second end margin sealing portions 4 and 5. The packaging bag 2 is thus completed via the side margin sealing portion 3 and the first and second end margin sealing portions 4 and 5. The film unit 6 is wrapped in the packaging bag 2 tightly. These sealing portion 3, 4 and 5 have larger thickness than the other portions of the packaging bag 2.

The film unit 6 is a box-like shape, and includes a front 6*a* having a larger size and a top 6*b*, as illustrated in FIG. 1, and a rear and a bottom (both not shown). A taking lens 6*c* projects from the surface of the front 6*a*.

Figure 2:
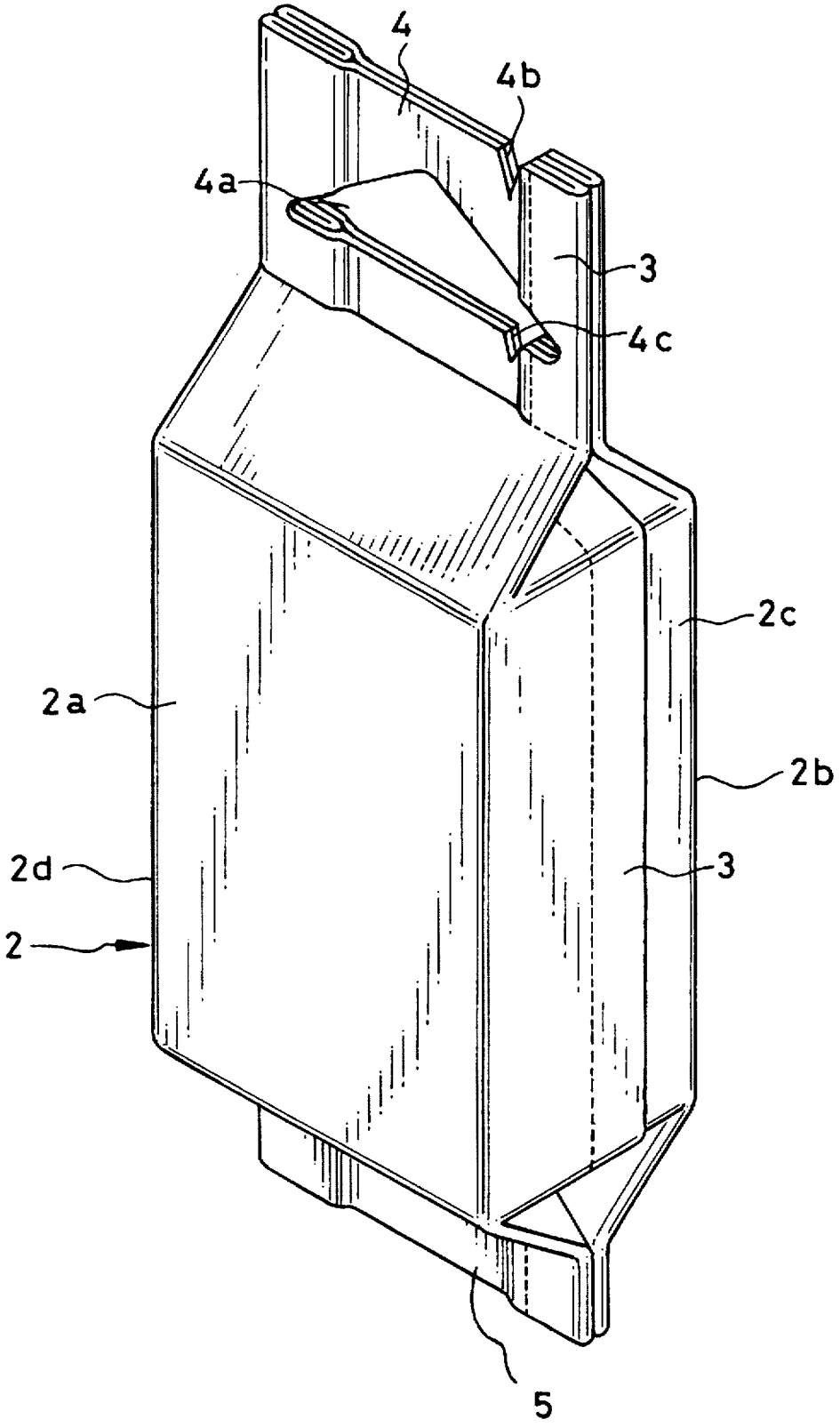
FIG. 2 is a perspective view illustrating an appearance of the packaging bag in FIG. 1.

As illustrated in FIG. 2, the side margin sealing portion 3 exists in the top 6*b* or bottom of the film unit 6. The first end margin sealing portion 4 is provided with a hanger hole 4*a* and first and second notches 4*b* and 4*c*. The hanger hole 4*a* is adapted for suspension on a hanger for commercial display in a store. The first notch 4*b* is formed at the edge of the first end margin sealing portion 4 near the side margin sealing portion 3, and the second notch 4*c* is formed in the hanger hole 4*a* to be coincident with the first notch 4*b* in the lengthwise direction. The packaging bag 2 is torn from the first notch 4*b* through the second notch 4*c* along the side margin sealing portion 3, to form an opening 10 for removal of the film unit 6.

Figure 3A:
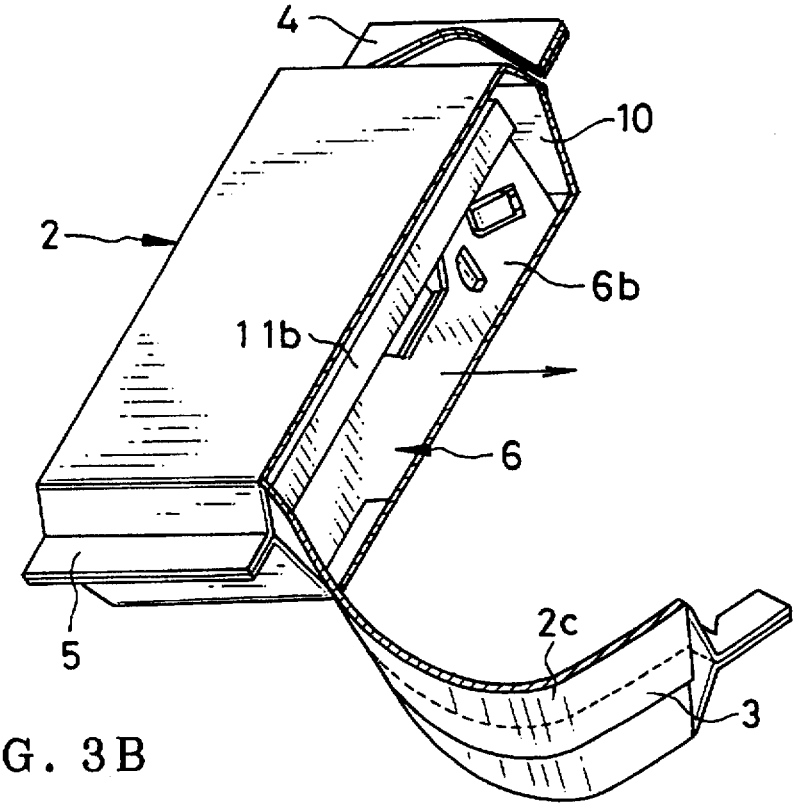
FIGS. 3A and 3B are explanatory views illustrating steps for removing the film unit.
Figure 3B:
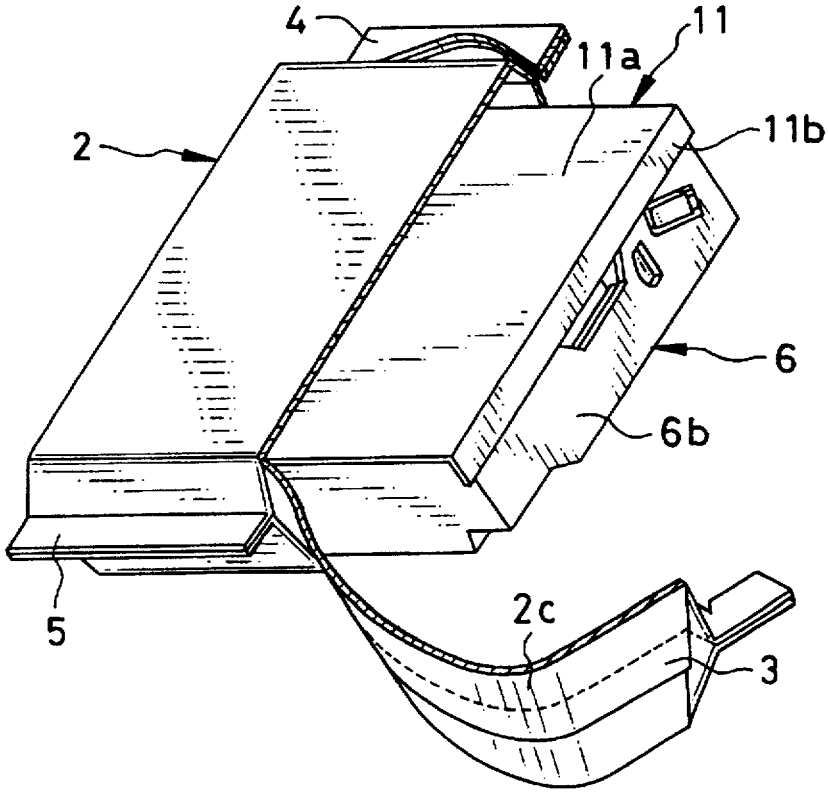

As illustrated in FIGS. 3A–3B, a tray 11 is of plastic plate or cardboard, and comprises a flat plane 11*a*, opposite bent ends 11*b*. The packaging bag 2 also packages the tray 11 with the film unit 6 so that the taking lens 6*c* contacts the flat plane 11*a* of the tray 11 to maintain the neat appearance of the packaging bag 2. One of the bent ends 11*b* appears from the opening 10, to serve to draw the film unit 6 from the packaging bag 2 on the tray 11. Surfaces of the tray 11 can be provided with information, such as instructions for operating the film unit 6 and advertisement for variation of the film units.

Now the operation of the above-described pillow type packaging is described. The film unit 6 as completed in its assembling line is placed on the tray 11 with its front contacting the tray 11. The lengthwise side margins of the PET sheet are sealed by heat-sealing to form the side margin sealing portion 3 so that the side margin sealing portion 3 is arranged in a position of the top 6*b* of the film unit 6. The opposite end margins are further sealed by heat-sealing to form the first and second end margin sealing portions 4 and 5. The first and second notches 4*b* and 4*c* are formed in the first end margin sealing portion 4 near the side margin sealing portion 3. Note that the present invention is described with the sheet of the packaging material for ease in explanation. However, in the actual packaging line, a continuous web of the packaging material is utilized as described in the prior art.

The film unit 6 and the tray 11 are thus packaged in the packaging bag 2, and shipped as a product. The front sheet side 2*a* is prevented from wrinkling due to the taking lens 6*c* because the front 6*a* of the film unit 6 is covered with the flat plane 11*a*. Therefore, the film units 6 can be displayed in the shop with a neat appearance.

When a user opens the packaging bag 2 to use the film unit 6, the first end margin sealing portion 4 is pulled toward the second end margin sealing portion 5 while nipping near the first notch 4*b*. The packaging bag 2 is torn from the first notch 4*b* via the second notch 4*c* along the side margin sealing portion 3. The upper sheet side 2*c* including the side margin sealing portion 3 is taken off to the end, as illustrated in FIG. 3A. The opening 10 is formed through which the top 6*b* of the film unit 6 appears. By picking the bent end 11*b* of the tray 11 and pulling it, the film unit 6 is drawn out together with the tray 11, as illustrated in FIG. 3B.

Since the side margin sealing portion 3 is actually the thickest portion of the packaging bag 2, it is difficult to tear the side margin sealing portion 3 in a crosswise direction thereof. Accordingly, the side margin sealing portion 3 serves as a guide to tear the packaging bag 2 to the end without tearing off the upper sheet side 2*c* in the course of pulling it. It is not necessary to utilize a PET sheet which is tearable in a regular direction for the packaging bag 2.

It is possible to remove the film unit 6 from the packaging bag 2 more easily in comparison with the conventional packaging bags because the side margin sealing portion 3 is helpful to tear the packaging bag 2, and the tray 11 is helpful to draw the film unit 6. Since the side margin sealing portion 3 is provided in the upper sheet side 2*c* of the packaging bag 2, there is no hindrance in the front and rear sheet sides 2*a* and 2*b*, namely, the wider size sides. These front and rear sheet sides 2*a* and 2*b* are provided with a printing such as illustrations, commercials and information about usage of the film unit 6. This makes it possible to increase the variation of the printing design of the packaging bag 2. The opening 10 is approximately the same size as the top 6*b* of the film unit 6, so that the film unit 6 can be removed from its small area side easily.

Instead of plastic plate or cardboard, the tray 11 may comprise other materials, synthetic paper or plastic sheet such as polypropylene and polystyrene. It is possible to omit the explanation for operating the film unit 6 from the outer surfaces of the packaging bag 2 because such description can be applied to the tray 11. The tray 11 may have advertisements for other types of the film units which are highly effective advertisement among film unit users. Moreover, the tray 11 can protect the taking lens 6c from damage through the packaging bag 2 when outside objects are struck against the taking lens 6c.

It is to be noted that the film unit 6 is wrapped in the packaging bag 2 while its top is directed to the side margin sealing portion 3 in the above-described embodiment. Of course, the film unit 6 may be wrapped with its bottom directed to the side margin sealing portion 3.

Figure 4A:
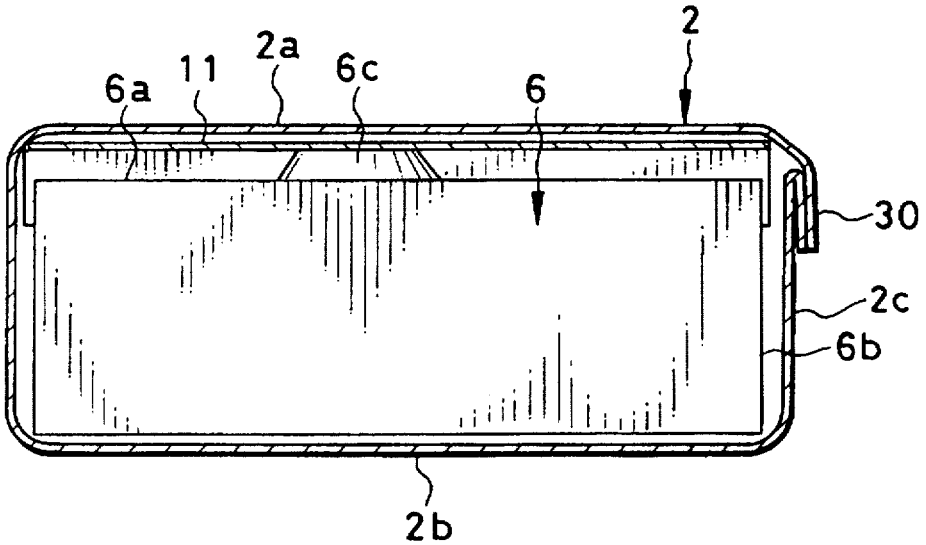
FIGS. 4A to 4C are section views illustrating other preferred embodiments of packaging bags in accordance with the present invention.
Figure 4B:
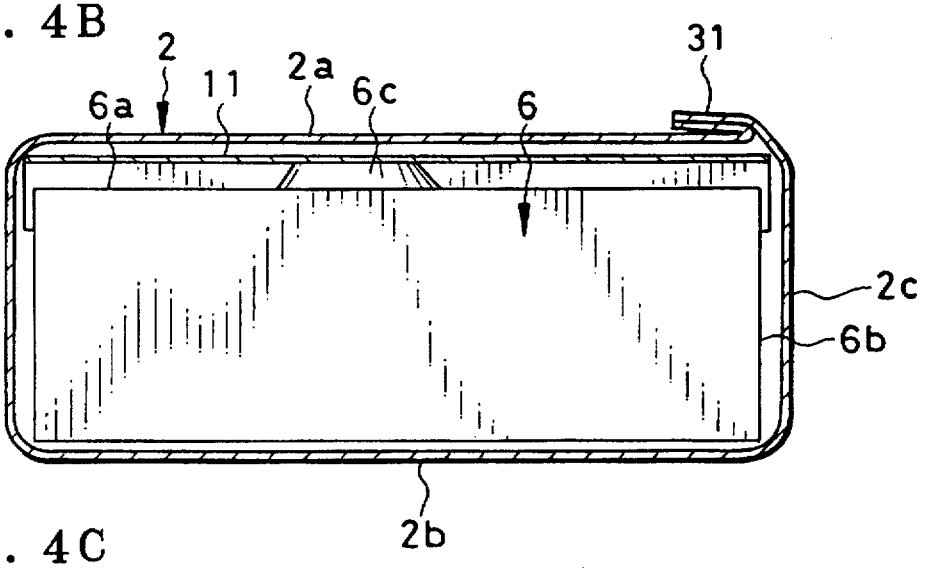
Figure 4C:
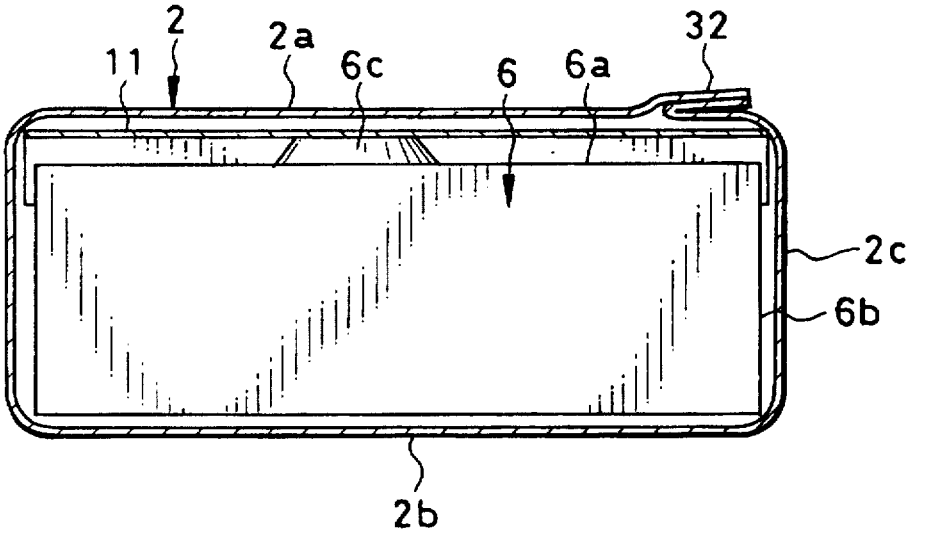

As illustrated in FIG. 4A, a side margin sealing portion 30 can be arranged near the corner of the upper sheet side 2c not in the center. As illustrated in FIG. 4B, it is also possible to arrange a side margin sealing portion 31 which is sealed starting from a position beside the corner of the upper sheet side 2c. It is further possible to arrange a side margin sealing portion 32 which is sealed starting from slightly far from the upper sheet side 2c but so that the lengthwise side edge of the side margin sealing portion 32 is positioned beside the corner of the upper sheet side 2c.

It is also possible to omit the notch 4c if the hanger hole 4a is in a position of the notch 4c and is as small as the notch 4c.

The present invention is applicable to packaging bag for other products required to be packaged in a hermetic manner, such as soap, crackers, a stack of paper and so on, not only for the film units.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A package for a product having an outwardly extended projection on one side thereof, the package comprising:

a sheet material formed into a generally rectangular tube, a first side of said tube being sealed at a side margin sealing portion and opposing ends of said tube being sealed at respective end margin sealing portions;

a notch in one of said end margin sealing portions near said side margin sealing portion for opening said first side substantially to the other of said end margin sealing portions which thereby forms a hole for removal of the product through said first side of the package; and a tray having a bottom portion which faces a second side of said tube which is adjacent said first side, said tray being slidably removable from the package through said hole in said first side when said first side has been opened, whereby said tray prevents the outwardly extended projection on one side of the package from contacting said sheet material when the one side of the product is placed face down on said tray in the package.

2. The package of claim 1, wherein said tray further comprises a bent side which abuts said first side of the package and which facilitates removal of said tray through said hole.

3. The package of claim 1, further comprising the product with an outwardly extended projection on one side thereof.

4. The package of claim 3, wherein said product is a film unit, and the projection is a taking lens.

5. The package of claim 1, wherein a side of said product exposed when said first side is opened is slightly smaller than said hole.

6. The package of claim 1, wherein said tray is substantially the same size as said second side of the package.

7. The package of claim 1, wherein said bottom portion of said tray comprises one of a plastic, cardboard, and synthetic paper.

8. A combination of a package and a film unit, the combination comprising:

said film unit having an outwardly extended taking lens on a front face thereof and a side face adjacent thereto which is smaller than said front face;

said package containing said film unit and comprising a sheet material formed into a generally rectangular tube which has a rectangular first side between larger rectangular second sides, said first side of said tube being sealed at a side margin sealing portion and opposing ends of said second sides being sealed at respective end margin sealing portions;

a notch in one of said end margin sealing portions near said side margin sealing portion for tearing open said first side along interfaces between said first side and said second sides substantially to the other of said end margin sealing portions, a hole being formed when said first side is torn open, said hole being larger than said side face of said film unit for allowing removal of said film unit through said first side of said package when said first side has been torn open; and a tray with said film unit therein, said tray having a bottom which is slightly larger than said front face of said film unit and which faces one of said second sides of said tube, said tray being slidably removable from said package through said hole in said first side when said first side has been torn open, said taking lens facing said bottom for preventing said taking lens from contacting said sheet material.

9. The combination of claim 8, wherein said tray further comprises a bent side which faces said first side of said package.

* * * * *